US005740259A

United States Patent [19]

Dunn

[11] Patent Number: 5,740,259

[45] Date of Patent: Apr. 14, 1998

[54] PRESSURE WAVE TRANSDUCING

[75] Inventor: Charles Dunn, Framingham, Mass.

[73] Assignee: Bose Corporation, Framingham, Mass.

[21] Appl. No.: 430,247

[22] Filed: Apr. 28, 1995

Related U.S. Application Data

[63] Continuation of Ser. No. 893,458, Jun. 4, 1992, abandoned.

[51] Int. Cl.[6] ..... H04R 1/02

[52] U.S. Cl. ..... 381/90; 381/154; 381/98; 381/88; 381/153; 381/159; 181/160; 181/148; 181/184; 181/185; 181/199

[58] Field of Search ..... 381/159, 153–156, 381/158, 24, 90, 87, 88, 188, 205, 98; 181/152, 159, 148, 151, 153–157, 160, 166, 177, 175, 184–190, 192–195, 199, 144, 145

[56] References Cited

U.S. PATENT DOCUMENTS

| | | | |
|---|---|---|---|
| 4,206,831 | 6/1980 | Welch et al. | 181/196 |
| 4,628,528 | 12/1986 | Bose et al. | 381/90 |
| 4,792,978 | 12/1988 | Marquiss | 381/203 |
| 4,930,596 | 6/1990 | Saiki et al. | 381/158 |
| 5,012,890 | 5/1991 | Nagi et al. | 181/153 |
| 5,111,509 | 5/1992 | Takeuchi et al. | 381/154 |
| 5,261,006 | 11/1993 | Nieuwendijk et al. | 381/158 |

FOREIGN PATENT DOCUMENTS

| | | | |
|---|---|---|---|
| 0456416 | 11/1991 | European Pat. Off. | 381/159 |
| 0314000 | 12/1988 | Japan | 381/154 |
| 63-314000 | 12/1988 | Japan | 381/154 |

*Primary Examiner*—Curtis Kuntz
*Assistant Examiner*—Ping W. Lee
*Attorney, Agent, or Firm*—Fish & Richardson P.C.

[57] ABSTRACT

An electroacoustical transducing system for exchanging pressure wave energy with a medium that propagates pressure waves includes an electroacoustical transducer having a vibratile surface. At least one low-loss pressure waveguide has one end adjacent to the vibratile surface and the other end adjacent to the medium. At least one acoustic immittance element is imposed in the length of the waveguide dimensioned and positioned to alter the transfer characteristic of the waveguide between the vibratile surface and the medium at the other end.

15 Claims, 4 Drawing Sheets

PRESSURE WAVE TRANSDUCING

This is a continuation of application Ser. No. 07/893,458, filed Jun. 4, 1992, now abandoned.

The present invention relates in general to pressure wave transducing and more particularly to acoustic waveguide transducing of the type disclosed in U.S. Pat. No. 4,628,528 granted Dec. 9, 1986, to Amar G. Bose for PRESSURE WAVE TRANSDUCING incorporated herein by reference.

It is an important object of this invention to provide an improved acoustic transducer.

According to the invention, an acoustic waveguide couples an electroacoustical transducer, such as a loudspeaker driver, to the region outside the waveguide adjacent the waveguide open end to reduce the impedance mismatch between the transducer and region to more efficiently transfer electroacoustical energy between the transducer and region. At least one acoustic immittance element, such as a constriction in the cross-sectional area of the waveguide, resides in the waveguide dimensioned and positioned to alter standing wave patterns within the waveguide in a manner which results in a predetermined improvement in frequency response and/or reduced noise.

Numerous other features, objects and advantages of the invention will become apparent from the following detailed description when read in connection with the accompanying drawings in which.

Figure 1:
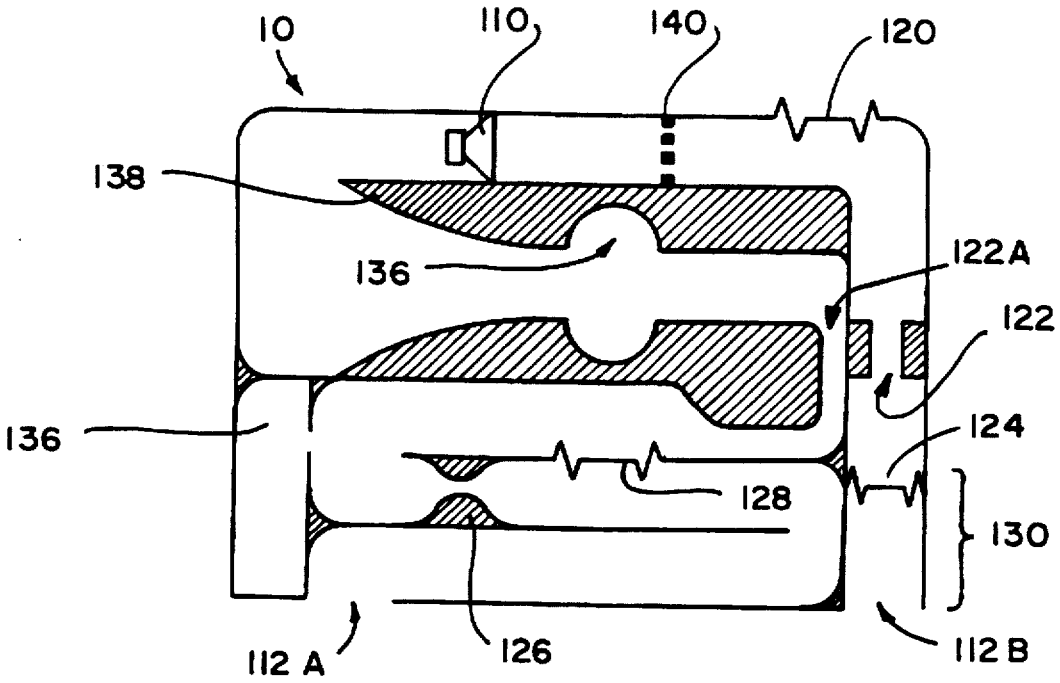
FIG. 1 is a diagrammatic representation of a generalized embodiment of the invention illustrating a number of immittance elements suitable for use in specific embodiments.

With reference now to the drawings and more particularly FIG. 1 thereof, there is shown a diagrammatic representation of a generalized embodiment of the invention. An acoustic waveguide 10 that is a low-loss pressure wave waveguide of the type described in the aforesaid Bose patent extends between open ends 112A and 112B and carries loudspeaker driver 110. One or more acoustic immittance elements, such as a passive radiator 120, an abrupt reduction in cross-sectional area 122 embracing a controlled volume of air affected by the abrupt yet short decrease in the waveguide cross-sectional area forming an acoustic immittance element, 120A, a diaphragm 124, a gaussian reduction in cross-sectional area 126, a compliant wall 128, an acoustic mass (inertance) 130, which is a mass of air arranged to move without appreciable compression so as to radiate acoustical power, an acoustic compliance 136, that is a controlled volume of air connected through a wall opening in a waveguide wall to the interior of the waveguide, 136A, an exponential connector between two different cross-sectional areas 138 or an acoustic resistance 140, that is a structure arranged to increase the contact area between air moving within the waveguide over the contact area outside the region containing the structure to thereby increase frictional resistance may be positioned and dimensioned to alter the impedance mismatch between driver 110 and the region adjacent to ends 112A and 112B in a predetermined manner.

According to the invention, the one or more immittance elements may be positioned and dimensioned to improve frequency response, facilitate electronic equalization, improve efficiency, reduce turbulence and port noise, and reduce cost.

Figure 2A:
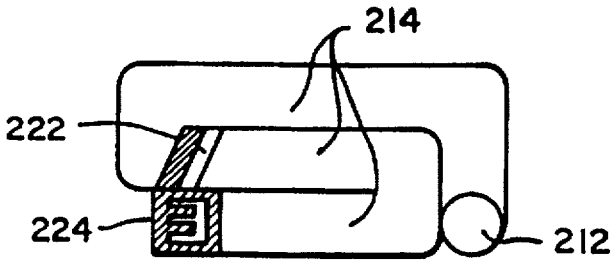
FIGS. 2A, 2B and 2C illustrate plan diagrammatic views in FIGS. 2A and 2B and an unfolded view in FIG. 2C illustrating a placement of restricting blocks in a waveguide of a two-waveguide loudspeaker, the Bose Acoustic Wave CD 2000 Music System.
Figure 2B:
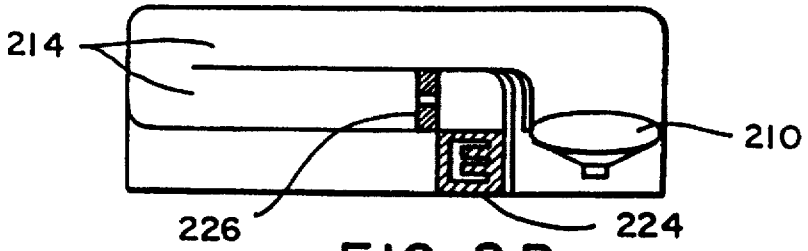
Figure 2C:
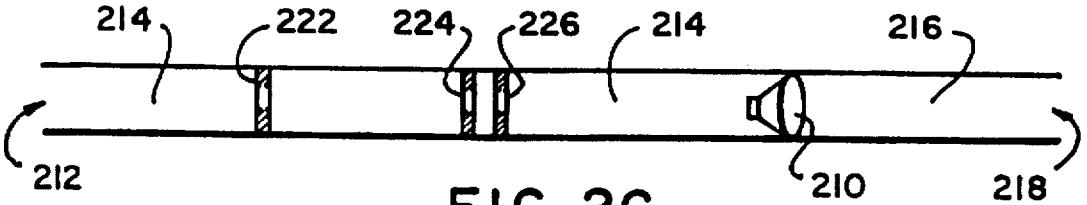

Referring to FIGS. 2A, 2B and 2C, there are shown diagrammatic representations of an exemplary embodiment of the invention representing modifications of the acoustic waveguide system in the BOSE ACOUSTIC WAVE CD 2000 music system to include acoustic immittance elements 222, 224 and 226 in long tube 214. FIGS. 2A and 2B show the immittance elements as seen in front and rear views, respectively, of the waveguide structure. FIG. 2C shows a representation of the acoustic waveguide unrolled to illustrate the location of the different immittance elements relative to the waveguide open ends 218 and 212 and driver 210 setting forth specific dimensions.

In the exemplary embodiment of the invention, the waveguide is a folded waveguide having a long tube and a short tube corresponding substantially to that disclosed in U.S. Pat. No. 4,628,528 and embodied in the commercially available BOSE ACOUSTIC WAVE music system, but with immittance elements. FIG. 1 is a diagrammatic plan view of a folded waveguide illustrating a wide variety of immittance elements. FIG. 2A is a diagrammatic view from the front in long tube 214 showing with arrows the path from driver 210 to open end 212 and to open end 218 of short tube 216. FIG. 2B is a diagrammatic view from the rear showing immittance elements 224 and 226. FIG. 2C is a diagrammatic view of the waveguide unfolded showing the location along the length of the waveguide of the immittance elements 222, 224 and 226 in the waveguide.

Figure 3A:
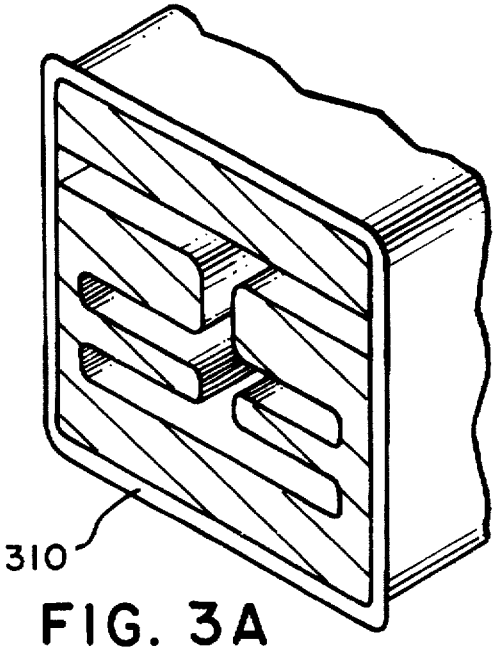
FIGS. 3A and 3B illustrate preferred shapes for the restriction elements.
Figure 3B:
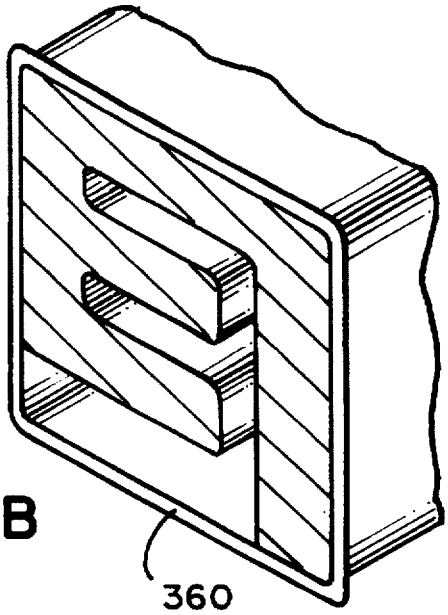

Referring to FIGS. 3A and 3B there are shown perspective views of a T restriction immittance element and E restriction immittance element, respectively, with specific dimensions used in the example of FIGS. 2A and 2B. T restriction immittance elements 222 and 226 are shown in FIG. 3A. E restriction immittance element 224 is shown in FIG. 3B. These E-shaped and T-shaped areas may be regarded as specific forms of concave areas.

The specific shape of the immittance elements is arranged to distribute open area relatively evenly across the original cross-sectional area of the tube while remaining relatively simple to mold and keeping port noise low and efficiency relatively high.

An approach for fabricating specific embodiments may include providing an indication of the radiated output as a function of frequency for a waveguide transducing system to provide an indication of one or more frequencies at which a change in response is desired and initially locating immittance elements in the waveguide substantially at points corresponding to the velocity extrema of the standing waves of the aforementioned frequencies, and altering the location and/or immittance properties of the respective elements to provide the desired frequency response while keeping noise low and maintaining relatively high efficiency.

An advantage of the invention is that it helps provide a frequency response characteristic that may be electronically equalized to provide a substantially uniform radiated power response as a function of frequency over the operating frequency range of the acoustic waveguide transducing system, typically of the order of 50 Hz, a low bass cutoff frequency, to 500 Hz.

Figure 4:
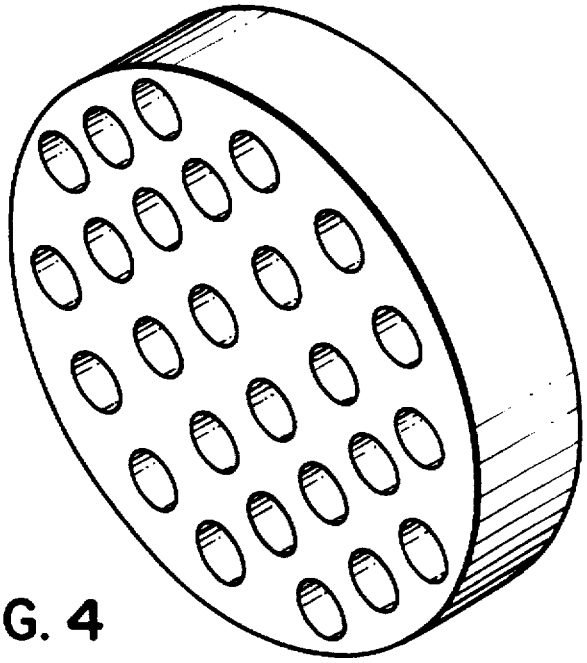
FIG. 4 is a perspective view of an element suitable for furnishing acoustic resistance.

Referring to FIG. 4, there is shown a perspective view of a suitable element 231 for furnishing acoustic resistance.

Figure 5:
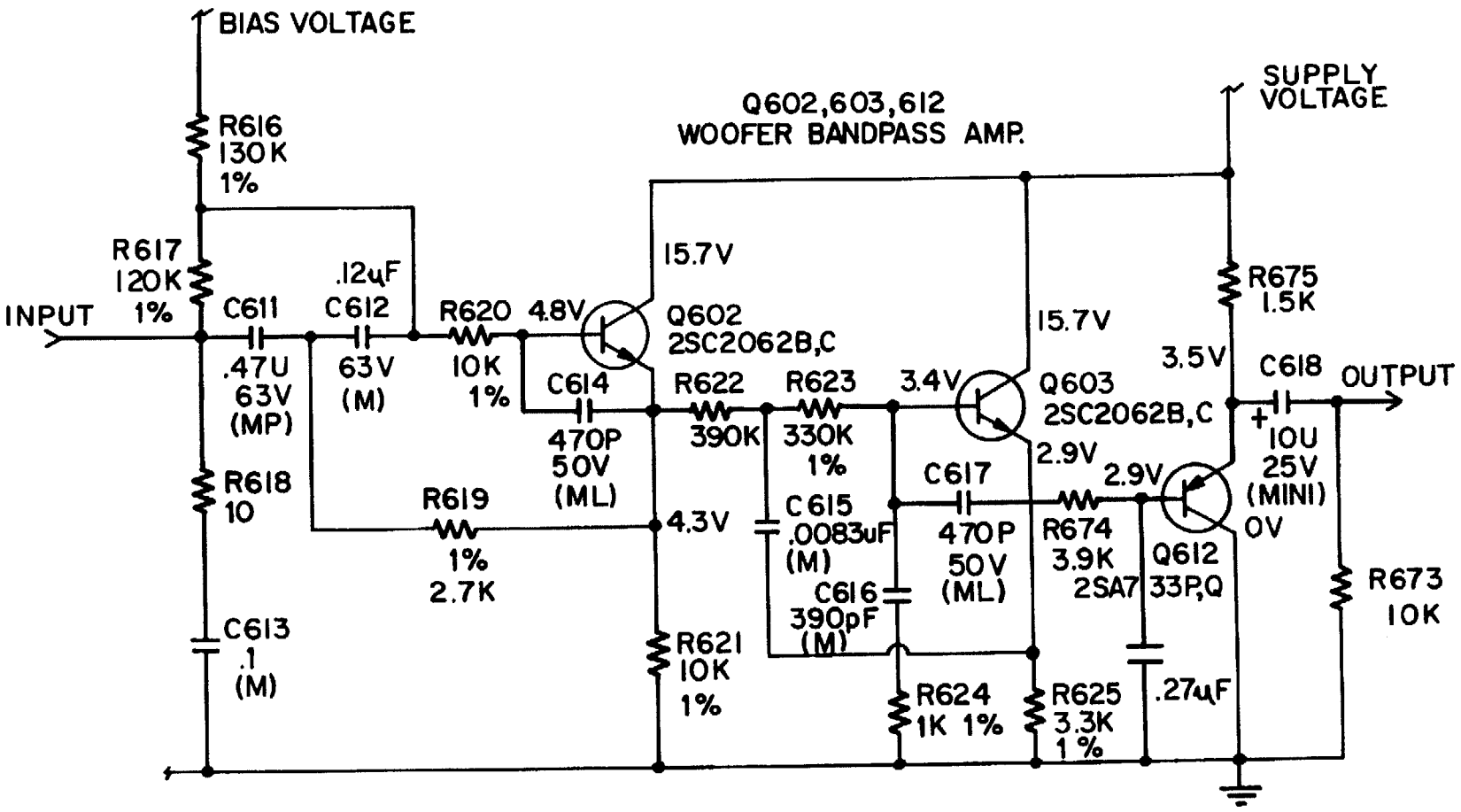
FIG. 5 is a schematic circuit diagram of a woofer bandpass amplifier.

Referring to FIG. 5, there is shown a schematic circuit diagram of electronic equalization circuitry suitable for use with the embodiment of FIGS. 2 and 3. This equalization circuitry has an input for receiving a signal having spectral components within the audio frequency range and is coupled to this embodiment for sharply reducing the system response below the low bass cutoff frequency.

Other embodiments are within the claims.

What is claimed is:

1. An electroacoustical transducing system for exchanging pressure wave energy with a medium that propagates pressure waves in the audio frequency range comprising, an electroacoustical transducer having a vibratile surface, at least one low-loss pressure wave waveguide, said waveguide having one end adjacent to said vibratile surface and the other end adjacent to said medium, and at least one acoustic immittance element imposed in the length of said waveguide dimensioned and positioned to alter the transfer characteristic of said waveguide between said vibratile surface and said medium at said other end, wherein said acoustic immittance element is positioned and dimensioned to reduce audible noise and alter the frequency response of said system while allowing said pressure wave waveguide to more efficiently transfer electroacoustical energy between said electroacoustical transducer and said medium as a result of being characterized by a waveguide impedance and effective length that reduces impedance mismatch between said vibratile surface and said medium, wherein said effective length corresponds substantially to a quarter wavelength at the lowest frequency of pressure wave energy to be transmitted between said medium and said vibratile surface.

2. An electroacoustical transducing system for reproducing sound in the audio frequency range in accordance with claim 1 characterized by a low bass cutoff frequency and further comprising, equalization circuitry having an input for receiving a signal having spectral components within the audio frequency range and coupled to said electroacoustical transducer for sharply reducing the system response below said cutoff frequency.

3. An electroacoustical transducing system in accordance with claim 1 wherein said electroacoustical transducer is a loudspeaker driver having a diaphragm comprising said vibratile surface.

4. An electroacoustical transducing system in accordance with claim 1 wherein said acoustic immittance element comprises structure that alters at least one of pressure and velocity in said waveguide where said immittance element is located.

5. An electroacoustical transducing system in accordance with claim 4 wherein said acoustic immittance element is located in an element region of said waveguide and presents an opening in said waveguide of cross-sectional area different from the cross-sectional area of said waveguide outside said element region.

6. An electroacoustical transducing system in accordance with claim 4 wherein said acoustic immittance element comprises a mass of air arranged to move without appreciable compression so as to radiate acoustical power.

7. An electroacoustical transducing system in accordance with claim 4 wherein said waveguide is formed with an abrupt yet short decrease in waveguide cross-sectional area which short decrease is of length much less than the length of said waveguide and said acoustic immittance element comprises a controlled volume of air affected by said abrupt yet short decrease in the waveguide cross-sectional area.

8. An electroacoustical transducing system in accordance with claim 1 and further comprising a second of said low-loss pressure wave waveguide having one end adjacent to said vibratile surface and the other end adjacent to said medium.

9. An electroacoustical transducing system in accordance with claim 8 and further comprising at least a second acoustic immittance element in said second waveguide dimensioned and positioned to alter the transfer characteristic of said second waveguide between said vibratile surface and said medium at said other end of said second waveguide.

10. An electroacoustical transducing system in accordance with claim 8 wherein said vibratile surface and said medium are characterized by pressure wave impedances that ordinarily involve a mismatch therebetween and each of said first and second acoustic waveguides is characterized by a characteristic impedance and a length that reduces the mismatch between said vibratile surface and said medium to more efficiently couple low frequency energy between said medium and said vibratile surface than would occur for different values of said waveguide impedance and said length.

11. An electroacoustical transducing system in accordance with claim 10 wherein the length of said first pressure wave waveguide is different from the length of said second pressure wave waveguide, whereby said first and second low-loss pressure waveguides coact to exhibit a transfer characteristic between said electroacoustical transducer and said medium having a more uniform frequency response characteristic than without said at least one acoustic immittance element.

12. An electroacoustical transducing system in accordance with claim 1 wherein said vibratile surface and said medium are characterized by pressure wave impedances that ordinarily involve a mismatch therebetween and said low-loss pressure wave waveguide is characterized by said waveguide impedance and said effective length that reduces the mismatch between said vibratile surface and said medium to more efficiently couple low frequency energy between said medium and said vibratile surface than would occur for different values of said waveguide impedance and said length.

13. An electroacoustical transducing system for exchanging pressure wave energy with a medium that propagates pressure waves in the audio frequency range comprising, an electroacoustical transducer having a vibratile surface, at least one low-loss pressure wave waveguide, said waveguide having one end adjacent to said vibratile surface and the other end adjacent to said medium, and at least one acoustic immittance element imposed in the length of said waveguide dimensioned and positioned to alter the transfer characteristic of said waveguide between said vibratile surface and said medium at said other end, wherein said acoustic immittance element is positioned and dimensioned to reduce audible noise and alter the frequency response of said system while allowing said pressure wave waveguide to more efficiently transfer electroacoustical energy between said electroacoustical transducer and said medium as a result of being characterized by a waveguide impedance and effective length that reduces impedance mismatch between said vibratile surface and said medium, wherein said effective length corresponds substantially to a quarter wavelength at the lowest frequency of pressure wave energy to be transmitted between said medium and said vibratile surface, wherein said acoustic immittance element comprises structure that alters at least one of pressure and velocity in said waveguide where said immittance element is located, wherein said acoustic immittance element comprises a compliant area within the relatively rigid waveguide wall which separates at least one of two different points within the waveguide and two additional different points in the region outside the waveguide and the region inside the waveguide.

14. An electroacoustical transducing system for exchanging pressure wave energy with a medium that propagates pressure waves in the audio frequency range comprising, an electroacoustical transducer having a vibratile surface, at least one low-loss pressure wave waveguide, said waveguide having one end adjacent to said vibratile surface and the other end adjacent to aid medium, and at least one acoustic immittance element imposed in the length of said waveguide dimensioned and positioned to alter the transfer characteristic of said waveguide between said vibratile surface and said medium at said other end, wherein said acoustic immittance element is positioned and dimensioned to reduce audible noise and alter the frequency response of said system while allowing said pressure wave waveguide to more efficiently transfer electroacoustical energy between said electroacoustical transducer and said medium as a result of being characterized by a waveguide impedance and effective length that reduces impedance mismatch between said vibratile surface and said medium, wherein said effective length corresponds substantially to a quarter wavelength at the lowest frequency of pressure wave energy to be transmitted between said medium and said vibratile surface, wherein said acoustic immittance element comprises structure that alters at least one of pressure and velocity in said waveguide where said immittance element is located, wherein said waveguide has a waveguide wall formed with a wall opening and said acoustic immittance element comprises a controlled volume of air connected through said wall opening to the interior of said waveguide.

15. An electroacoustical transducing system for exchanging pressure wave energy with a medium that propagates pressure waves in the audio frequency range comprising, an electroacoustical transducer having a vibratile surface, at least one low-loss pressure wave waveguide, said waveguide having one end adjacent to said vibratile surface and the other end adjacent to said medium, and at least one acoustic immittance element imposed in the length of said waveguide dimensioned and positioned to alter the transfer characteristic of said waveguide between said vibratile surface and said medium at said other end, wherein said acoustic immittance element is positioned and dimensioned to reduce audible noise and alter the frequency response of said system while allowing said pressure wave waveguide to more efficiently transfer electroacoustical energy between said electroacoustical transducer and said medium as a result of being characterized by a waveguide impedance and effective length that reduces impedance mismatch between said vibratile surface and said medium, wherein said effective length corresponds substantially to a quarter wavelength at the lowest frequency of pressure wave energy to be transmitted between said medium and said vibratile surface, wherein said acoustic immittance element comprises structure that alters at least one of pressure and velocity in said waveguide where said immittance element is located, wherein said structure is arranged to increase the contact area between air moving within said waveguide over the contact area outside the region containing said structure to thereby increase frictional resistance.

* * * * *